United States Patent [19]

Izquirdo

[11] Patent Number: 4,724,163

[45] Date of Patent: Feb. 9, 1988

[54] PROCESS FOR OBTAINING TEXTILES NOT DETECTABLE BY INFRA RED RADIATION

[76] Inventor: D. Eduardo Frances Izquirdo, Zuniga Rodriguez, 02, Bejar (Salamanca), Spain

[21] Appl. No.: 803,571

[22] Filed: Nov. 27, 1985

[30] Foreign Application Priority Data

Dec. 3, 1984 [ES] Spain ..... 538.214

[51] Int. Cl.[4] ..... B05D 5/00

[52] U.S. Cl. ..... 427/160; 427/389.9; 427/393.2; 427/393.4

[58] Field of Search ..... 427/160, 389.9, 393.4, 427/393.2, 393.1; 8/115.6

[56] References Cited

U.S. PATENT DOCUMENTS

| | | | |
|---|---|---|---|
| 2,405,038 | 7/1946 | Jennings | 427/389.9 |
| 2,424,386 | 4/1947 | Czeczowitzkg | 427/389.9 |
| 2,465,336 | 3/1949 | MacDonald et al. | 427/389.9. |
| 2,527,530 | 10/1950 | Cassel et al. | 427/389.9 |
| 2,606,845 | 12/1952 | Van Etten | 427/389.9 |
| 2,900,354 | 8/1959 | Auer et al. | 427/389.9 |
| 4,150,191 | 4/1979 | Kazki | 427/160 |

*Primary Examiner*—Janyce A. Bell

*Attorney, Agent, or Firm*—Larson and Taylor

[57] ABSTRACT

Lampblack is added to an otherwise conventional aqueous textile resin finishing solution to render the textile undetectable by infrared radiation detection. The lampback is preferably dispersed in a resin used in the aqueous solution.

4 Claims, No Drawings

PROCESS FOR OBTAINING TEXTILES NOT DETECTABLE BY INFRA RED RADIATION

The present invention relates to a process to obtain textiles which cannot be detected by infrared radiation.

The process according to the invention is to obtain textiles which, subjected to detection by infrared radiation, whether by photographic means or even by means of optical electronic detection apparatuses, absorb said radiation, which makes them invisible to said process of detection.

Its most important application resides in its use for military purposes, wherein it is most fundamentally and frequently used because of its camouflage properties.

At the present time, only two methods are known about in the textile field, one in the United States, and the other in France, which is obtained by incorporation of lampblack into the mass to obtain polyester filament which later is transformed into fiber which is suitable for use in textiles.

The process object of this invention allows incorporation of the lampblack into any class of textile fiber, whether natural, synthetic or artificial, in any phase of its manufacture, including: flocking, combing, thread or fabric, independent of the color or texture of the weave or mixture of fibers.

Generally speaking, the process resides in obtaining dispersion of the lampblack in resins of textile finish, if the finish is modifiable or not modifiable, in such a manner that after its incorporation in an aqueous bath, the particles of lampblack are kept finely dispersed. Thus, having obtained the aqueous solution and with the particles in dispersion, it is possible to deposit this over the textile substrate by means of a process by impregnation and run-off with subsequent drying and polymerization by draining, by means of the hydrolysis of the bath in slightly acid pH.

The novelty introduced by this process is remarkable in that until this time the use of lampblack in the textile field, not in manufacture of fibers, is the first time that it is done for the purpose of camouflage.

On the other hand, and herein is found a new application, it is possible to deposit the lampblack over any textile fiber, in aqueous medium, which is traditionally used in the textile industry for the transformation and preparation of textiles. The lampblack is insoluble and with this process, stable aqueous dispersions are obtained which allow its industrial use. It is also to be added that the lampblack deposited in powder form in the textiles will not have fastness to comply with most of the requirements of the DIN or ISO textile strandards which are commonly accepted in the textile industry, such as rubbing, dry cleaning or wet washing, and other industrial specifications to which the textiles are subjected during the process of manufacture into woven fabrics. With the process of this invention, the resin not only allows the obtaining of a dispersion of easy industrial use, but also after the drying and polymerization, acts as a reticulating agent, which adheres the particles to the textile and covers it in the form of a very thin film, giving it the same fastness as that of the resins, to fulfill the various requirements which the woven fabrics must realize, which is obtained with one or various finished textile resins, according to the type of finish bath which the textile requires, according to the relevant phase of manufacture or where it is obliged to be definitively terminated.

Another important novelty of the invention is the possibility of depositing quantities in certain percentages on the textile, according to the degree of immunity to detection by infrared light, but that the woven fabric is not substantially altered in either its touch or its color to any appreciable degree.

With this process, woven fabrics or textiles are obtained in any state of manufacture, which, subjected to light or to the action of light sources or infrared sources, beyond the extreme red, i.e. greater than 700 nanometers, absorb said radiation and are not detected by the means which traditionally are used for their detection, such as IR photographic film in black and white and in color, which maximum detection is near to 1200 nanometers, equivalent to a zone of sensitization of between 6500 and 8500 Angstroms. So much other occurs with the apparatuses which combine optical and electronic functions to make said radiations visible to the naked eye.

The process according to the invention, generally speaking, is as follows:

Lampblack is used in the form of the most pure variety of amorphous carbon, with a composition of 98–99% carbon and 2–3% hydrogen. The cited black is obtained by the duly regulated combustion with limited quantities of air, of fatty oils, tars, petroleum, turpentine, etc., according to what is suitable in accordance with the market demand.

The lampblack in powder form which is thus obtained is insoluble in aqueous medium, and because of this it is difficult to apply in the textile industry and to avoid this drawback the following process should be followed: It is bonded with a concentrated resin until a homogenous and stable dispersion is obtained, using for this purpose the commercial dispersions and emulsions which carry the resins.

This bonding phase is followed by the dissolution of the resin in an aqueous solution used for the bonding, by means of continuous stirring, until it is considered to be finished.

The impregnation of the textile is put into effect by the process of padding and run-off, or by drainage, as is explained below in more detail. That is followed by the drying process, for which the temperature must be between 50° and 80° or 90° C. according to the textile which is being treated.

Finally, the polymerization follows, wherein the operation must agree (be performed in accordance) with the resins used as support for the lampblack, but in general it will have to be from 130° to 140° or 170° C. and will last for a period of 3 to 5 minutes. Both the drying and the polymerization are common to all of the processes to be described.

Resin to be used:

Simple resins with double function are used: on the one hand the resin allows the dispersion or emulsion, as needed, of the lampblack powder, which allows its application in industry with the conventional tools used in the textile industry for fluids. On the other hand, a suitable reticulation is carried out to obtain the following fastnesses which are required for articles and textile material which are of current use:

Fastness to light: 6–7
Fastness to washing at 30°: 4–5
Fastness to water: 5
Fastness to alkaline perspiration: 4
Same acid: 4
Fastness to 180° C. heat: 4–5

Resins:

The selection of the resins to use as diluents and supports of the lampblack will depend upon the desired results, taking into account that the requirements are to be fulfilled at all times as determined for various types of textiles or woven fabrics, accordingly, whether they are clothing articles, work fabrics, articles for shelter, raincoats, etc. After numerous tests, the major results obtained are in the resins and concentrations of lampblack which are described hereinafter:

Finishes which modify the touch:

Formol-urea and -melamine resins up to 15 g/l and 0.5 g/l of lampblack, continuously, Polyvinyl chloride and acrylic resins up to 25 g/l and 0.5 g/l of lampblack, continuously Polysiloxane resins and other atonic softening agents up to 1.5% and 0.3% of lampblack over the fiber weight, by drainage at 40° C., and 5.5 pH with cation.

Weather-proofing

Silicones and other polysiloxanes up to 50 g/l and 1 g/l of lampblack, continuously (Silicones and polysiloxanes, as aforementioned.)

Chromium salts in isopropyl alcohol, found: up to 50 g/l and 0.7 g/l of lampblack, continuously Zirconium salts and chlorinated paraffins: up to 50 g/l and 1 g/l of lampblack, continuously.

Tests are continued over other types of resins so as to determine their fastness and results of application.

All of the tests carried out and to be carried out have as their goal to incorporate lampblack into the textiles with guarantees of fastness and easy application, which until this time have not been used in the textile industry, so as to obtain textiles which absorb the infrared radiation beyond 700 nanometers so they may be easy to camouflage from detection by means of photography with infrared-sensitive high-speed films of any type, and also it obstructs the detection by infrared telescopic apparatuses, combining both optical and electronic functions in a range between 600 and 1250 nanometers, and also a zone of tolerance obtained with the Beckman spectrum is obtained.

NOTA: The preceding is sufficiently described and it only remains to indicate that which is declared the subject and novelty of the applicant, is found in the following:

I claim:

1. A process of rendering textiles undetectable by infrared radiation detection which comprises:

providing an aqueous textile finishing solution comprising lampblack and a resin dispersed therein, said resin acting as both a dispersing agent for dispersing said lampblack in said aqueous textile finishing solution and as a reticulating agent for binding said aqueous textile finishing solution to a textile;

impregnating a textile with said textile finishing solution such that the entire textile is impregnated;

drying the impregnated textile; and curing said resin whereby said textile is rendered undetectable by infrared radiation detection.

2. A process according to claim 1 wherein said aqueous textile finishing solution transforms a physical characteristic of the surface of a textile when said resin is cured.

3. A process according to claim 2 wherein said aqueous textile finishing solution is one which modifies the touch of said textile.

4. A process according to claim 2 wherein said aqueous textile finishing solution is one which weatherproofs said textile.

* * * * *